United States Patent [19]

Seifert

[11] Patent Number: 4,572,434

[45] Date of Patent: Feb. 25, 1986

[54] FUEL INJECTION NOZZLE FOR INTERNAL COMBUSTION ENGINES

[75] Inventor: Kurt Seifert, Esslingen-Zollberg, Fed. Rep. of Germany

[73] Assignee: Robert Bosch GmbH, Stuttgart, Fed. Rep. of Germany

[21] Appl. No.: 559,679

[22] Filed: Dec. 9, 1983

[30] Foreign Application Priority Data

Mar. 4, 1983 [DE] Fed. Rep. of Germany ..... 3307671

[51] Int. Cl.[4] ..... F02M 61/08; F02M 61/16

[52] U.S. Cl. ..... 239/453; 239/533.3; 239/533.12

[58] Field of Search ..... 239/533.2, 533.3, 533.4, 239/533.5, 533.6, 533.7, 533.8, 533.9, 533.11, 533.12, 452, 453

[56] References Cited

U.S. PATENT DOCUMENTS 1,735,718 11/1929 Attendu ..... 239/533.5

3,718,283 2/1973 Fenne ..... 239/533.9

FOREIGN PATENT DOCUMENTS 2099077 12/1982 United Kingdom ..... 239/533.2

*Primary Examiner*—Jeffrey V. Nase

*Assistant Examiner*—Daniel R. Edelbrock

*Attorney, Agent, or Firm*—Edwin E. Greigg

[57] ABSTRACT

A fuel injection nozzle for internal combustion engines having a valve needle opening outward and connected with a piston which defines a damping chamber filled with fuel. Upon the opening stroke of the valve needle, the damping chamber communicates with the flow path of the fuel only via a throttling conduit. The damping chamber is formed in a cap, which is mounted upon the piston and centers itself on the piston. The cap is supported on the nozzle housing toward the side of the injection opening via a pre-stressed support spring, and the cap and the support spring are confined between stops attached to the housing. Therefore, the damping can be limited in a manner dependent on pressure or speed.

2 Claims, 2 Drawing Figures

FUEL INJECTION NOZZLE FOR INTERNAL COMBUSTION ENGINES

BACKGROUND OF THE INVENTION

The invention is based on a fuel injection nozzle. In such injection nozzles, the damping effect can be limited in accordance with pressure by providing for appropriate matching of a support spring with the coefficient of damping. In many cases this is desirable in the high engine rpm range if the restoring spring is capable of returning the cap or the part acted upon by it to its outset position by the beginning of the next injection event. In the known injection nozzles of this type, the cap and the support spring are held in a cage, which is displaceably guided between two stops attached to the housing and is pressed as a unit by the restoring spring against one of these stops. This embodiment makes assembly easier; however, it does require the supplementary part of the cage.

OBJECT AND SUMMARY OF THE INVENTION

An object of the present invention is to provide an improved fuel injection nozzle which is simpler than known fuel injection nozzles. The improvement is brought about by dispensing with the cage for the support spring and the cap.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
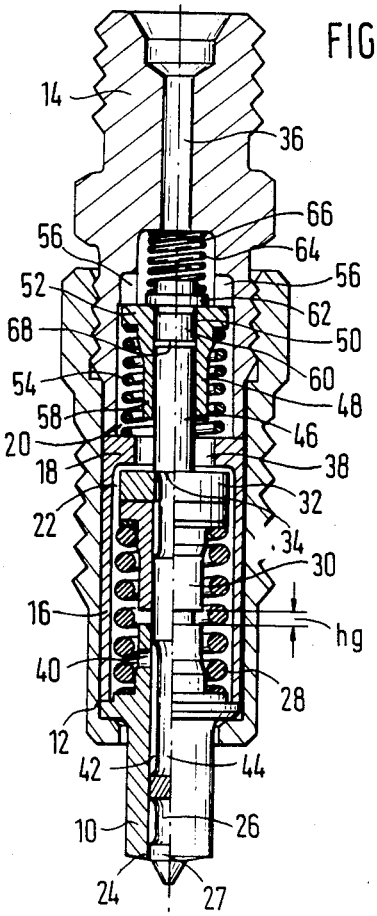
FIG. 1 is a longitudinal section taken through the exemplary embodiment of the invention.

An injection nozzle has a nozzle body 10, which is held firmly on a nozzle holder 14 by a sleeve nut 12. A sheath 16 is disposed between the nozzle body 10 and the nozzle holder 14 and has an inwardly pointing flange or collar 18, which divides an upper chamber 20 from a lower chamber 22 in the interior of the injection nozzle. A valve seat 24 is formed in the nozzle body 10 and a valve needle 26 is displaceably supported therein, the valve needle includes a sealing cone 27 which is pressed by a closing spring 28 against the valve seat 24. The closing spring 28 is supported on a shoulder of the nozzle body 10 and via a flanged part 30 which surrounds the valve needle and engages a support disc 32 which is supported on a shoulder 34 of the valve needle 26.

The nozzle holder 14 includes an inflow bore 36 discharging into the upper chamber 20, which communicates with the lower chamber 22 via an opening 38 surrounded by the collar 18. From the lower chamber 22, a radial bore 40 leads within the nozzle body 10 into an annular chamber 42, which is formed between the central bore wall of the nozzle body 10 and the jacket circumference of a section 44 of reduced diameter of the valve needle 26 and extends to just before the valve seat 24. In the closing position shown, there is a distance $h_g$ between the flanged part 30 and the nozzle body 10, and this distance corresponds to the total stroke of the valve needle 26. The valve needle 26 is displaced outward in the opening direction by the fuel pressure, counter to the closing spring 28, until the flanged part 30 strikes against the nozzle body 10. Upon closure of the valve, the closing spring 28 applies a force against the lower shoulder of the nozzle body and the flanged part 30 which guides the valve needle 26 inward into the closed position shown.

A piston-like extension 46 is contiguous with the shoulder 34 of the valve needle 26 and protrudes through the opening 38 and into the upper chamber 20. The diameter of the piston-like extension 46 corresponds to the guideance diameter of the valve needle 26. A bushing 48 is placed with a predetermined amount of radial play on the extension 46. The bushing 48 has a through bore 50 and a flanged rim 52. The flanged rim 52 is engaged by a support spring 54, which is supported on the collar 18 and presses the bushing 48 against shoulders 56 in the nozzle holder 14. The nozzle holder 14 is provided with radial slots adjoining the shoulders 56 through which fuel passes downwardly to chamber 20. The end section 58 of the bushing 48 remote from the flanged rim 52 has an outer diameter which is smaller than the inner diameter of the collar 18.

A closing body 60 which is provided with an annular collar 62 also protrudes with a predetermined amount of radial play into the bore 50 of the bushing 48 in axial alignment with piston like extension 46. The annular collar 62 is engaged by a restoring spring 64, which is supported on an annular shoulder 66 of the nozzle holder 14. Between the ends facing one another of the piston-like extension 46 and of the closing body 60, a damping chamber 68 filled with fuel is formed, which communicates in a throttled manner via the radial play surrounding the extension 46 in the bore 50 with the flow path of the fuel. This flow path leads from the inflow bore 36 via the upper chamber 20 and the opening 38 into the lower chamber 22, from whence the fuel travels via the bore 40 in the nozzle body 10 and along the annular chamber 42 to reach the valve seat 24.

The injection nozzle functions as follows:

Prior to the beginning of an injection event, the parts assume the positions illustrated, in which the bushing 48 is pressed against the shoulders 56 of the nozzle holder 14 and the annular collar 62 of the closing body 60 rests on the upper end face of the bushing 48. In this position because the valve needle is at its highest position, the volume of the damping chamber 68 is at its smallest. As the fuel pressure increases, a pressure difference arises between the damping chamber 68 and the upper chamber 20 because the bushing 48, on account of the functioning of the support spring 54, cannot at first follow the movement of the valve needle 26, and the fuel reaches the damping chamber 68 in a delayed manner, having to travel via the radial play about the extension 46 and perhaps around the closing body 60. The support spring 54 is designed such that during idling and in the lower rpm range of the engine, the pressure difference is not capable of overcoming the initial stress of the support spring 54, so that the damping is effective over the entire needle stroke.

In the upper rpm range, the pressure difference between the upper chamber 20 and the damping chamber 68 increases to such an extent that the initial stress of the support spring 54 is overcome. With the compression of the support spring 54, the bushing 48 follows the valve needle 26, so that the damping effect is no longer reinforced further. By the appropriate selection or adjustment of the support spring 54, the damping effect can thus be limited to a desired extent in accordance with pressure. Upon the closing stroke of the valve needle 26, the bushing 48 and the closing body 60 at first are deflected upward, relieving the support spring 54 and stressing the restoring spring 64, until the bushing 48 comes to rest on the shoulders 56. During the remaining closing stroke of the valve needle 26 which follows, the extension 46 presses the closing body 60 upward and away, via the cushion of fuel enclosed within the damping chamber 68, and further compressing the restoring spring 64. The restoring spring 64 is dimensioned such that on the one hand the valve needle 26 can execute its remaining closing stroke without any particular hindrance and on the other hand the quantity of fuel that has flowed into the damping chamber 68 is positively displaced from the damping chamber 68, except for the residual volume shown, by the beginning of the next opening stroke of the valve needle 26.

Figure 2:
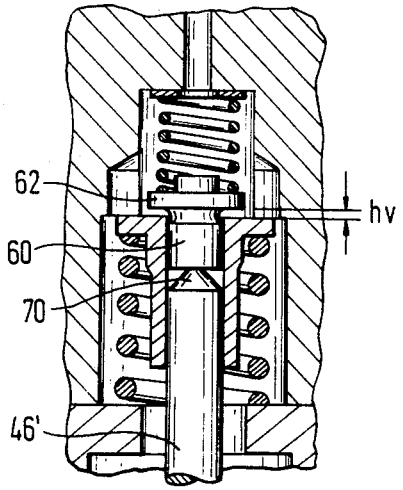
FIG. 2 shows a variant of the embodiment shown in FIG. 1.

In the variant shown in FIG. 2, a piston-like extension 46' of the valve needle has a frustoconical end protrusion 70, on which the closing body 60 is seated in the closing position of the valve needle. In this position, the annular collar 62 of the closing body 60 is at a distance $h_v$ from the upper end face of the bushing 48; this distance corresponds to an undamped pre-stroke. During this pre-stroke $h_v$, the closing body 60 follows the valve needle or in other words its extension 46', and the movement of the valve needle takes place without being damped. As a result, it is attained that at the beginning of each injection event, a preliminary fuel stream containing a sufficiently large fuel quantity is ejected. After the closing body 60 takes its seat upon the bushing 48, the further movement of the valve needle is damped in the manner described.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection nozzle for internal combustion engines, comprising a nozzle body supported by a sleeve nut, a nozzle holder secured in said sleeve nut, a valve needle supported in said nozzle body and loaded by a closing spring that surrounds said valve needle, said valve needle opening in a flow direction of a fuel relative to a valve seat in said body, the valve needle including a piston-like extension, a bushing including a flanged rim on one end and a through bore such that said bushing surrounds said piston-like extension with a clearance that forms a throttling conduit therebetween, a shoulder formed within said nozzle holder, said bushing being supported on the shoulder of said nozzle holder via a pre-stressed support spring supported within said nozzle holder, a closing body extending into said bushing juxtaposed said piston-like extension of said valve needle, a damping chamber formed within said bushing between an end face of said piston-like extension and an end face of said closing body, said closing body including an annular collar juxtaposed said flanged rim of said bushing, a restoring spring supported on one end of said closing body, said restoring spring forcing said closing body toward said bushing and said closing body is deflectable counter to a force of the restoring spring and displaceably guided relative to said bushing.

2. An injection nozzle as defined by claim 1, in which the throttling conduit is formed by a radial play between a wall formed by said bore of said bushing and said piston-like extension and said closing body.

* * * * *